United States Patent [19]

Harrigan

[11] 4,240,577

[45] Dec. 23, 1980

[54] LOCKING ENVELOPE

[75] Inventor: Richard V. Harrigan, Tonawanda, N.Y.

[73] Assignee: Niagara Envelope Co. Inc., Buffalo, N.Y.

[21] Appl. No.: 98,519

[22] Filed: Nov. 29, 1979

Related U.S. Application Data

[63] Continuation-in-part of Ser. No. 931,375, Aug. 7, 1978, abandoned.

[51] Int. Cl.[3] ..... B65D 27/22

[52] U.S. Cl. ..... 229/76; 229/84

[58] Field of Search ..... 229/76, 81, 84; 150/7; 206/260

[56] References Cited

U.S. PATENT DOCUMENTS

| | | | |
|---|---|---|---|
| 74,867 | 2/1868 | Ullman | 229/76 |
| 180,200 | 7/1876 | Chapman | 229/76 |
| 1,459,414 | 6/1923 | Parks | 229/76 |
| 1,459,415 | 6/1923 | Parks | 229/76 |
| 3,124,299 | 3/1964 | Stone et al. | 229/81 |
| 3,756,504 | 9/1973 | Bock | 229/76 |
| 3,955,752 | 5/1976 | Harrigan | 229/84 |

FOREIGN PATENT DOCUMENTS

| | | | |
|---|---|---|---|
| 1295571 | 5/1962 | France | 229/76 |
| 356440 | 9/1931 | United Kingdom | 229/76 |

*Primary Examiner*—Stephen P. Garbe

*Attorney, Agent, or Firm*—Christel, Bean & Linihan

[57] ABSTRACT

An envelope which is closed and secured without adhesive for repeated use. A tuck, flap extension of the closure flap is infolded and tucked back in between the back panel and a lock flap partially overlying the back panel. The back panel and the lock flap, folded back upon it, are secured to the front panel by overlying end tabs.

3 Claims, 2 Drawing Figures

LOCKING ENVELOPE

CROSS-REFERENCE TO RELATED APPLICATION

This application is a continuation-in-part of patent application, Ser. No. 931,375, filed Aug. 7, 1978 now abandoned.

BACKGROUND

The subject matter is envelopes, and particularly an envelope for repeated use which is closed and secured without the use of adhesive.

The prior art, of which the present invention is considered an improvement, includes U.S. Pat. No. 3,756,504 to Bock. The Bock patent discloses an envelope that works in ostensibly the same way as does the envelope of the present invention. A tuck flap extension 18 of the closure flap 16 is infolded and tucked back inbetween the back panel 12 and the lock flap 14 as in the present invention. However, there are significant structural and practical distinctions in the present invention which will now be described.

It is an object of the present invention to provide an envelope which is closed and secured, without adhesive, for repeated use, such envelope being formed of a single sheet of material and configured to reduce wear and destruction from undue stress.

For a better understanding of this invention, reference is made to the following detailed description of an exemplary embodiment, given in connection with the accompanying drawing.

DRAWING

DESCRIPTION

Figure 1:
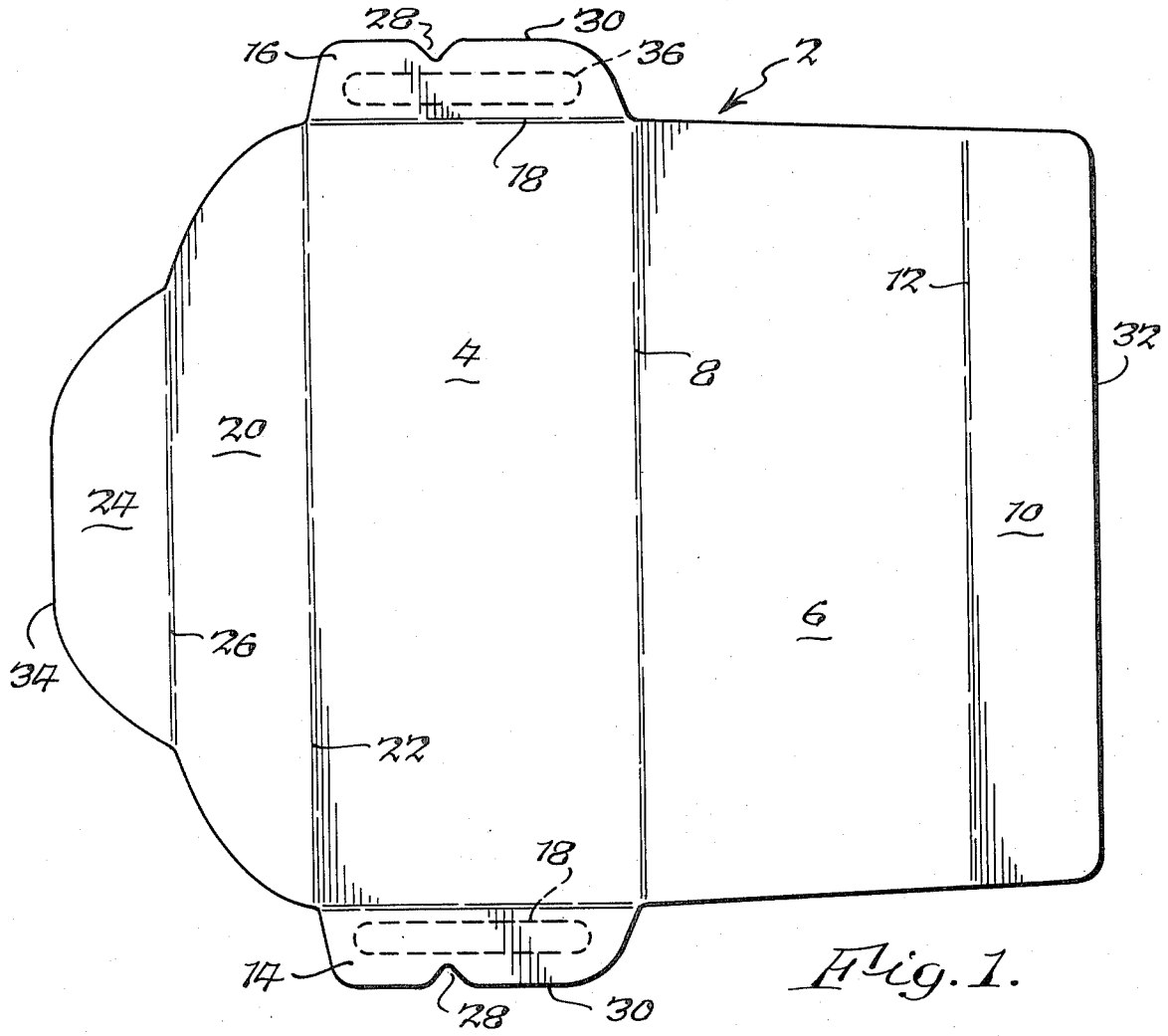
FIG. 1 is a plan view of a single sheet of material from which the envelope of this invention is made.

Referring now to FIG. 1, the envelope of this invention is shown generally at 2 in its prefolded condition. Envelope 2 includes a front panel 4 and a back panel 6 joined and folded relative to each other along a common bottom edge 8. A lock flap 10 extends from the back panel 6 and is folded back thereon along a top lid 12. End tabs 14 and 16 extend from the ends of the front panel 4 and are infolded relative to the front panel 4 along end edges 18. A closure flap 20 extends from the front panel 4 and is folded over the panel 4 along a top edge 22. A tuck flap 24 in turn extends from the closure flap 20 and is folded back thereon along a single or double scored flat edge 26. By means of a double scored edge 26, if provided, extra expansion in the envelope is made available, if necessary. Leading edge 32 of the lock flap and leading edge 34 of the tuck flap form the end extremities of the envelope.

The end tabs 14 and 16 include notches 28 in their leading edges 30. Notches 28 are characterized by inclined edges defining generally V-shape as is shown in the drawing although a generally arcuate shape is appropriate as well. The notches extend a minor portion of the distance between the edge of the end tabs and the end edge of the front panel but terminate short of adhesive strip 36. The notches are positioned along the end tab edges at a location which intersects leading edge 32 of the lock flap when the envelope is in assembled configuration as is illustrated in FIG. 2.

Figure 2:
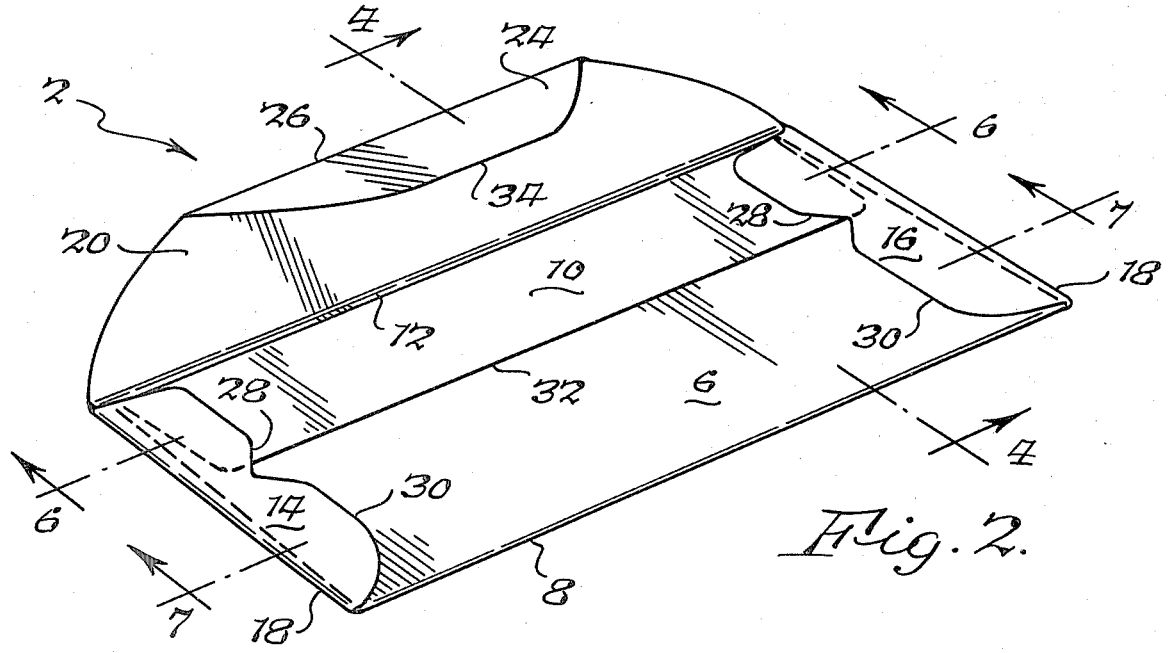
FIG. 2 is a perspective view of an open envelope according to this invention.

Referring to FIG. 2, the folded or "assembled" configuration of the envelope 2 can readily be understood. First, the back panel 6 is folded along the bottom edge 8 over the front panel 4. The lock flap 10 is then back folded along the top lid 12 and onto the back panel 6. End tabs 14 and 16 are then infolded, along the end edges 18 and overlie the back panel 6 and the lock flap 10. End tabs 14 and 16 are fixed in this folded position by means of a suitable adhesive represented in FIGS. 1, 6 and 7 by the numeral 36. The adhesive is positioned in a strip adjacent end edges 18 and extending substantially the length of the end tabs. Width of the adhesive strip 36 is such that the bottoms of notches 28 remain free of restraint. Front panel 4 and back panel 6 together define an envelope pocket 38, the desired container space within the envelope. Back panel 6 and lock flap 10 in turn define a lock pocket 40 which opens in the direction opposite that of the envelope pocket 38.

Figure 3:
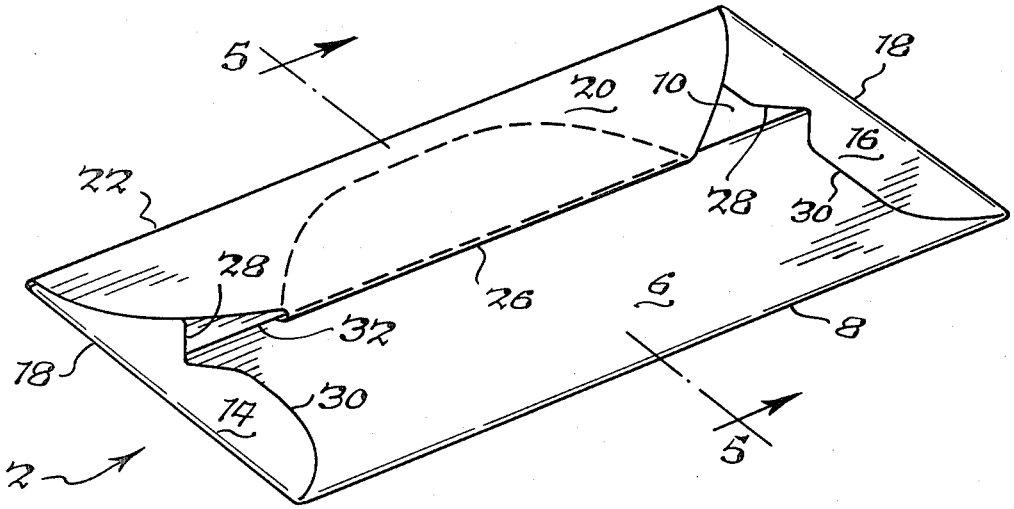
FIG. 3 is a perspective view of the same envelope in its closed configuration.

FIG. 3 shows the envelope of this invention in its closed secured configuration. Here, the closure flap 20 is folded over and the tuck flap 24, extending from closure flap 20, is backfolded under the leading edge 32 of the lock flap 10 and up into the lock pocket 40.

Figure 4:
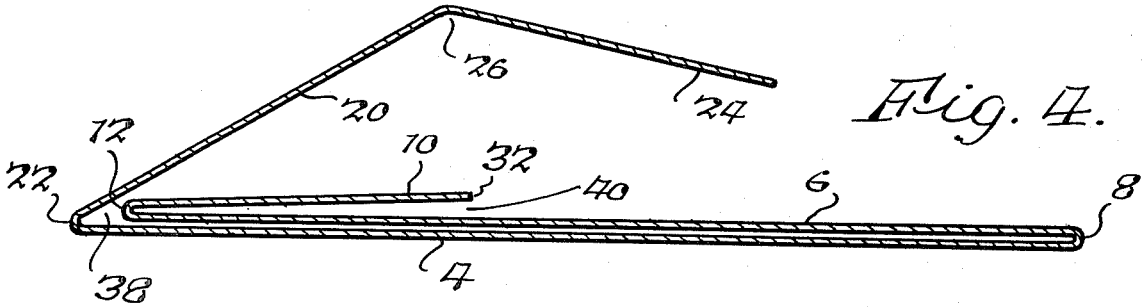
FIG. 4 is a sectional view taken along the line 4—4 of FIG. 2.
Figure 5:
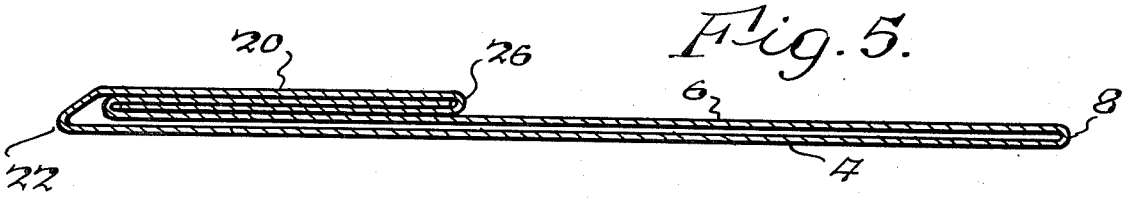
FIG. 5 is a sectional view taken along the line 5—5 of FIG. 3.
Figure 6:
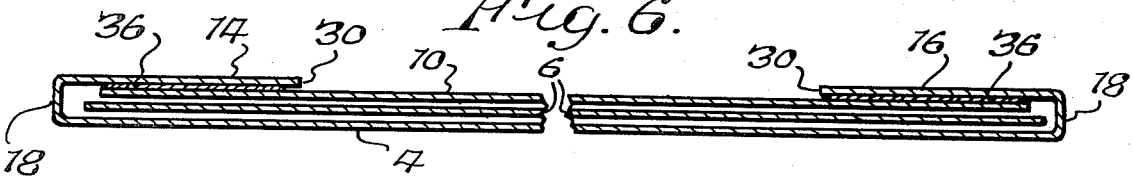
FIG. 6 is a sectional view taken along the line 6—6 of FIG. 2.
Figure 7:
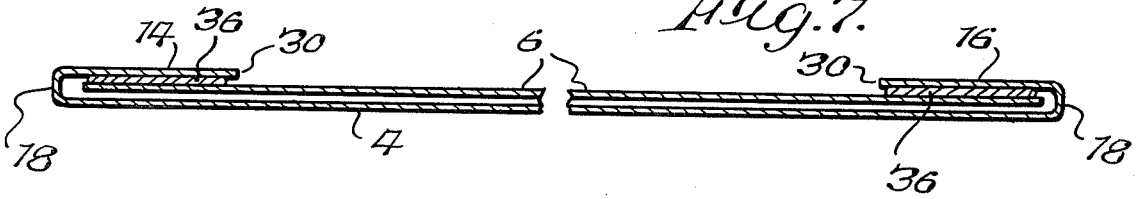
FIG. 7 is a sectional view taken along the line 7—7 of FIG. 2.

FIG. 4 shows the section the envelope in the same open condition as in FIG. 2. Similarly, FIG. 5 shows the envelope in the sectional view in the same closed condition as in FIG. 3. FIGS. 6 and 7 are sectional views taken respectively along lines 6—6 and 7—7 of FIG. 2. These figures help to show the order in which the several panels and tabs are stacked in the final envelope configuration.

Referring back to FIGS. 1—3, and particularly FIG. 3, the end tabs 14 and 16 are shown with their leading edges 30 nothed at 28. The end tabs 14 and 16, because of the notches 28, cross and overlie the leading edge 32 of the lock flap at an acute angle. It is to be noted here, and with respect to the following claims, that the angle referred to is the angle defined between either edge of notch 28 and edge 32 of the lock flap, and facing the lock flap 10. The angular conjunction of end tabs 14, 16 and the lock flap 10 is significant. This geometry is effective to relieve lateral stress concentrations which would otherwise result at the ends of the lock flap leading edge 32 if end tabs 14 and 16 were to simply lay over the lock flap 10 perpendicular to its leading edge 32. The slanting sides of the notches 28 provide in effect an area of relief as the edge 32 is flexed upwardly, as distinguished from point contact which would result from a perpendicular crossing of end tab (leading edge 30) and lock flap (leading edge 32). Placement of the adhesive strip 36 so as not to overlap or abut the notches 28 allows a degree of lateral movement between the end tabs and the lock flap thus significantly decreasing the stress developed as edge 32 is flexed upwardly during opening and closing of the envelope.

The comparative effects of an angular relief edge versus perpendicular crossing of the tabs over the lock flap can be illustrated by considering a common situation where a sheet of paper is torn from a pad or is torn along a straight-edge. For effective tearing, it is well known that a "point" of stress between paper and cutting edge is to be maintained. If a "line of contact" between paper and edge is created, or a "line of stress," the paper will not easily tear. The "line of contact" formed by inclined edges of notches 28 and flap edge 32 provides this benefit; the flap 10 does not so easily tear on its "line of contact" with tabs 14 and 16. Even if the leading edge 32 of the flap 10 is not exactly aligned with the center of the tab notches a "line of contact" will still be formed regardless of where the leading edge 32 falls within the notch area.

An additional advantage of the construction of the envelope, with end tabs 14 and 16 overlying and enfolding the back panel and lock flap, is that the length dimension of the lock pocket 40 can be precisely controlled. This precision of dimension is not possible in the prior art where it depends on the placement and the extent of a quantity of adhesive.

Similar considerations apply to the closure flap and tuck flap 20 and 24. The operation of these flaps, that is the tucking and untucking of the envelope, is greatly facilitated by the inclined side edges, i.e., their somewhat trapezoidal shape.

The operation or opening and closing of the envelope of this invention is greatly facilitated by the geometry described. Furthermore, the substantial reduction in stress concentrations resulting from this geometry results in a more durable envelope for longer life.

The foregoing description of an embodiment of this invention is given by way of illustration and not of limitation. The concept and scope of the invention are limited only by the following claims and equivalents thereof which may occur to others skilled in the art.

I claim:

1. An envelope formed of a single sheet of paper or the like comprising:

a. a rectangular front panel and a rectangular back panel, said panels being folded back on each other along a common bottom edge, b. a substantially rectangular lock flap extending from said back panel and folded back thereon along a common top edge parallel to said bottom edge, c. an end tab extending from each end of said front panel and folded back along the end edges thereof, said end tabs enfolding and being secured to said back panel and to said lock flap by means of an adhesive encompassing a central area of each of said end tabs thereby securing said panels and lock flaps in folded condition, d. each of said end tabs having a leading edge and a generally V-shaped notch extending a minor portion of the distance between the leading edge of each said end tabs and the adjacent end edge of said front panel but terminating short of said adhesive, said notches being located to cross and overlie the leading edge of said lock flap at acute angles relative thereto whereby a line of contact is effectively made to relieve lateral stress concentrations, e. said front and back panels defining an envelope pocket, said back panel and said lock flap defining a lock pocket opening in the direction opposite to that of said envelope pocket, f. a closure flap extending from said front panel and folded back thereon along a common top edge parallel to said bottom edge to overlie said lock flap, and g. a tuck flap extending from said closure flap and folded back thereon along a common flap edge parallel to said top edge, said tuck flap being adapted to tuck under said lock flap and into said lock pocket to releasably secure said envelope in closed condition.

2. An envelope as defined in claim 1 in which sid closure flap and said tuck flap are generally trapezoidal in shape for ease in opening and closing of said envelope.

3. An envelope as defined in claim 1 or claim 2, in which said adhesive is a strip.

* * * * *